United States Patent [19]

Kobayashi et al.

[11] 4,223,927

[45] Sep. 23, 1980

[54] CAR DOOR LOCK DRIVING DEVICE

[75] Inventors: Nobuo Kobayashi; Sadao Nakano, both of Yokohama, Japan

[73] Assignee: Niles Parts Co., Ltd., Tokyo, Japan

[21] Appl. No.: 946,413

[22] Filed: Sep. 27, 1978

[30] Foreign Application Priority Data

Apr. 28, 1978 [JP] Japan ..... 53-055823[U]

[51] Int. Cl.[3] ..... E05C 13/10

[52] U.S. Cl. ..... 292/1; 292/336.3; 74/750 R

[58] Field of Search ..... 292/336.3, 1, 201, 144; 74/750 R

[56] References Cited

U.S. PATENT DOCUMENTS

| | | | |
|---|---|---|---|
| 3,486,352 | 12/1969 | Bouthors et al. | 70/264 |
| 3,498,571 | 3/1970 | Dilling et al. | 74/750 R X |
| 4,093,289 | 6/1978 | Inabayashi et al. | 292/201 X |
| 4,135,377 | 1/1979 | Kleefeldt et al. | 292/201 |

*Primary Examiner*—Richard E. Moore

*Attorney, Agent, or Firm*—Lane, Aitken, Ziems, Kice & Kananen

[57] ABSTRACT

A device for locking car doors with a motor and a reduction gearing and having the following construction; (a) a timer starts to work upon depressing a lock knob by a driver, whereby a relay is actuated, (b) the operation of the relay actuates a motor and rotates a sun gear incorporated in a casing, (c) friction plates installed opposite to each other are drawn into contact by energizing a driving coil in the casing, (d) as a result, an actuator works to turn, and lock knobs provided at the respective doors are operated through a linkage, thus locking the doors all together, (e) once the actuator moves to the door locking position, automatic stop switches are changed over and current to the aforesaid motor and driving coil is checked.

7 Claims, 3 Drawing Figures

CAR DOOR LOCK DRIVING DEVICE

BACKGROUND OF THE INVENTION

1. Field of the Invention

This invention relates to a car door lock driving device functioning to transmit the torque of a motor actuated through a relay to a gear mechanism and reduction gearing, and further to lock the car doors all at once by means of an electromagnetic clutch and a linkage. Particularly, it relates to a construction including the above mentioned driving device in a casing.

2. Description of the Prior Art

A device adapted heretofore to lock the car doors has been generally of the type that operates a linkage through a linear operation type solenoid. The device of this type, however, has incurred various inconveniences shown below.

(a) Although the operating stroke from unlocking to locking the doors is to be determined depending on the door construction, the device per se has had to be made larger to ensure a predetermined operating stroke and driving power with the linear operation type solenoid, which has resulted in increase in the weight.

(b) Because of a large current of approximately 15 amperes being required for driving the device, the switch which controls the alternate energization and de-energization of the solenoid has had to be provided with a great contact capacity.

(c) As a result of the externals having become larger eventually, there has been some restriction substantially on the installing position of the device inside the door and usually, the device has been attached at the lower side of the door. Thus, it has been liable to be affected by water entering the door especially while raining.

(d) The device has been relatively noisy in operation, which has been undesirable in terms of abatement of unnecessary sound.

SUMMARY OF THE INVENTION

The present invention has been made intending to eliminate substantially the aforementioned various inconveniences and/or shortcomings involved in the prior art.

The summary of this invention is that a driving device so constructed as to lock the car doors correctly, namely, a device comprising substantially a motor, reduction gearing provided for increasing the torque of said motor and an electromagnetic clutch installed at the output side of said reduction gearing and working to transmit and cut a torque obtained from the output side of the reduction gearing to/off a linkage which controls to unlock and lock the car doors can be provided. It is a principal object of the present invention to provide a car door lock driving device wherein a certain operating stroke in the locking and unlocking operation of each door and a predetermined driving power as well can easily be obtained. It is another object of the present invention to provide a car door lock driving device which can be made compact and lightweight. It is a further object of the present invention to provide a car door lock driving device equipped with a reduction gearing whereby the motor torque can be increased, thus enabling the motor to be compact in size with a small capacity thereby reducing the power consumption. It is another object of the present invention to provide a car door lock driving device permitting the lock knobs of the individual doors to operate lightly at a time of completion of locking and/or unlocking operation of the doors. It is a still further object of the present invention to provide a car door lock driving device mountable at the upper portion inside each door since it can be made compact, thus negating the chance of being moistened, which is detrimental to the electrical mechanism. It is a further object of the present invention to provide a car door lock driving device operative very quietly with minimal noise.

DESCRIPTION OF THE PREFERRED EMBODIMENTS

Figure 1:
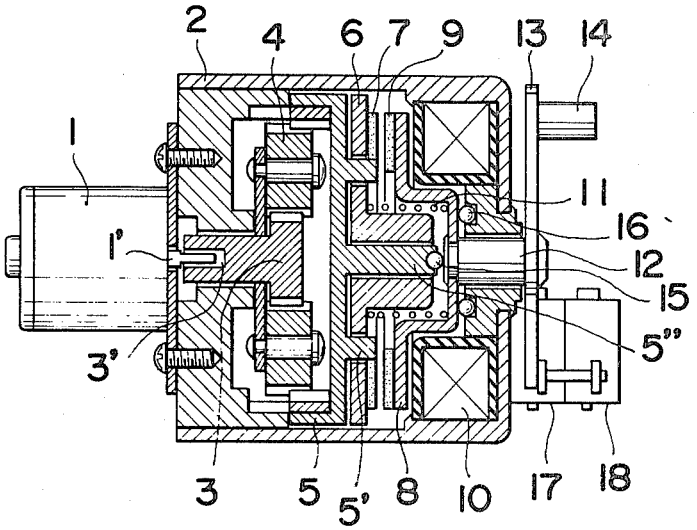
FIG. 1 is a vertical sectional view showing a suitable embodiment of the car door lock driving device of the present invention.
Figure 2:
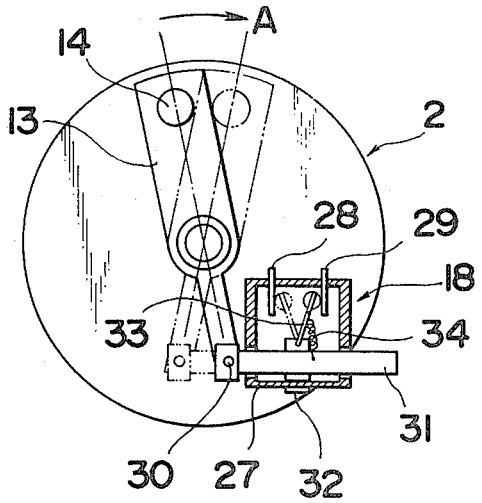
FIG. 2 is a right side view illustrating the section of the major portion in FIG. 1.
Figure 3:
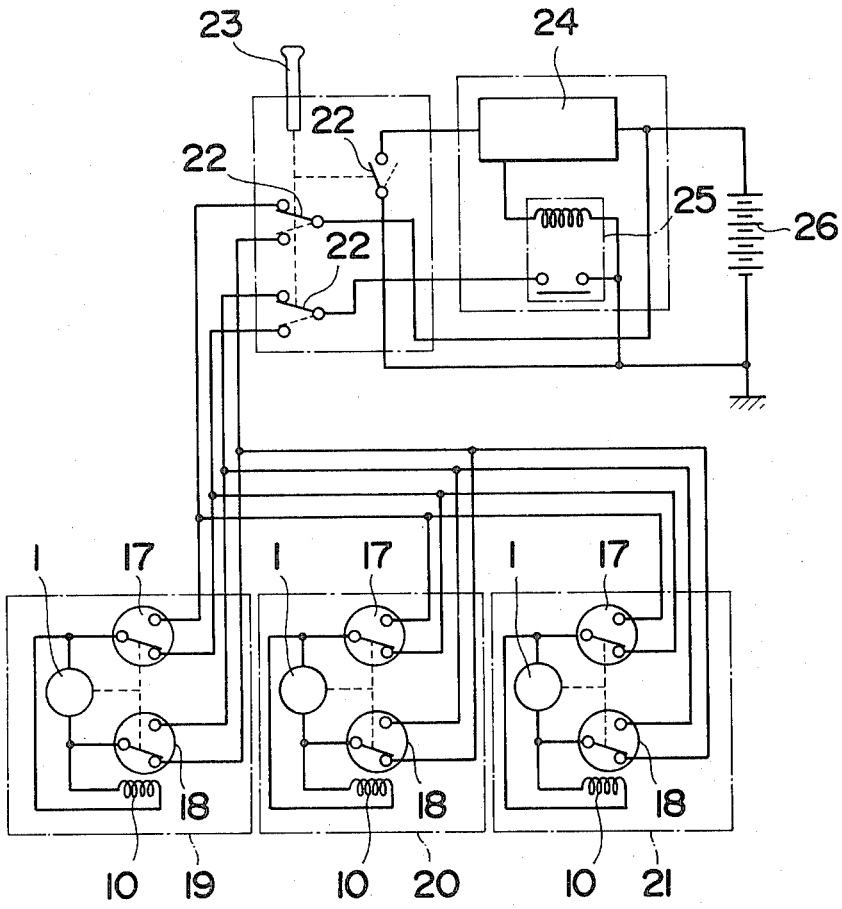
FIG. 3 is an electric circuit diagram of the embodiments of the present invention and shows the actually installed condition thereof.

Referring now to FIG. 1, FIG. 2 and FIG. 3, there is given a detailed description of a suitable embodiment of the present invention. In FIG. 1, 1 is a motor secured to a casing 2. 3 is a sun gear provided for transmitting the torque of the motor 1 to a planetray gear 4. 1' is a rotary shaft of said motor 1 and the end thereof at the sun gear side is formed flat. 3' is a slot of the sun gear 3 and provided at the center of the shaft of said sun gear 3. The flat end of the rotary shaft 1' of the motor 1 is engaging into the slot 3' of said sun gear 3 to deliver the torque of the motor 1 to the sun gear 3. 5 is an internal gear and said planetary gear 4 is in contact therewith inside. A reduction gearing which comprises substantially the sun gear 3, the planetary gear 4 and the internal gear 5 is built in the casing 2 and formed coaxially with motor 1. 6 is a disc comprising a magnetic substance, and to the one side face thereof, a friction plate 7 is fitted. Said disc 6 is engaging with a boss 5' provided on the internal gear to rotate together with the internal gear 5 and yet it is kept in a condition where it can disengage any time as required. 8 is a receiving plate having a discal configuration and to the one side face thereof, a friction plate 9 is secured. The plate is incorporated in the casing 2 in a freely rotatable state and placed opposite to said disc 6. 10 is a driving coil installed inside the casing 2 and acts to attract the disc 6 once current flows to the coil. Said casing 2 comprises a magnetic substance. 11 is a spring installed between the disc 6 and the receiving plate 8 and works to keep the aforesaid friction plates 7 and 9 separate from each other normally. The receiving plate 8 is secured to the one end of a shaft 12 which is inserted into the casing 2 in a freely turnable condition and the other end thereof is joined to an actuator 13. The actuator 13 has a pin 14 which engages with a linkage which takes charge of locking and/or unlocking the doors substantially. 15 is a steel ball and placed between a center shaft 5'' of the internal gear 5 and the shaft 12 to ensure smooth rotation and proper support of the internal gear 5. 16 is a steel ball and put between the receiving plate 8 and the inside face of the casing 2 with the object of helping the receiving plate 8 to rotate smoothly and besides support correctly against the thrust pressure by the receiving plate 8. 17 and 18 are automatic stop switches and work to stop the rotation of the motor 1 at a predetermined position when the actuator 13 is driven. The automatic stop switches 17 and 18 also function as a reversing switch of the motor 1. FIG. 2 shows the example of the automatic stop switch. The automatic stop switch 18 is fitted with fixed terminals 28 and 29 in a housing 27 and further, an operating member 31 connected to an engaging pin 30 of the actuator 13 passes through the housing 27. Also, secured to the housing 27 is a supporting piece 32 and the supporting piece 32 holds a moving contact plate 33 with a moving contact. Further, a spring 34 is hooked onto said moving contact plate 33 and operating member 31 respectively. Thus, the automatic stop switches 17 and 18 are operated by the actuator 13. The driving coil 10 is connected in parallel with the motor 1 so that it can be energized while the motor 1 is being powered. Once the driving coil 10 is energized, the disc 6 is attracted to the driving coil 10 side, whereby the friction plates 7 and 9 are drawn to contact each other. The electromagnetic clutch is substantially made up of the aforementioned disc 6, friction plates 7 and 9, driving coil 10 and spring 11. FIG. 3 shows an electric circuit diagram of the embodiments actually installed on the car doors. 19, 20, and 21 are door lock driving devices attached respectively to the door of the front assistant driver's seat and the rear right and left doors. These devices take charge of locking and unlocking the doors substantially. 22, is a manual-operated lock switch installed at the door at the driver's seat side and actuates the driving devices 19, 20 and 21 all together when the driver depresses a lock knob. 24 is a timer and functions to keep a relay 25 active only for a certain time by the action of said manual-operated lock switch when the lock knob is depressed or pulled up to allow the driving devices to continue working only for a fixed time. 26 is a d-c power source. The car door lock driving device of the present invention has the above mentioned construction and the operation thereof is as follows. Upon pushing the lock knob 23 by the driver after two doors each at the front and rear of the car are closed, the door at the driver3 s seat side is first locked and the manual-operated lock switches 22 are changed over to the side where the doors are locked and simultaneously the timer 24 begins to work and thereby the relay 25 is actuated and the motor 1 and the driving coil 10 are energized. When the motor 1 rotates, the sun gear 3 also turns accordingly and the planetary gear 4 revolves around the sun gear 3 while self-rotating according to the rotation of the sun gear 3. And, the internal gear 5 rotates at low speed. As the driving coil 10 is kept energized while the motor 1 is in motion, the disc 6 is drawn to the side of driving coil 10 by the magnetomotive force, and the result is that the friction plates 7 and 9 are drawn into contact, a powerful torque produced by the internal gear 5 is delivered to the receiving plate 8 and the actuator 13 is put into action. The moment the actuator 13 operates, the lock knobs (not indicated in the drawing) provided at other doors than that at the driver's seat side are operated through a linkage (not indicated in the drawing), thereby the doors are locked all at once. When the actuator 13 moves to a position whereat the doors are locked as shown by an arrow A, it means that the actuator 13 is at a position indicated by a virtual line (alternate long dashes and two dots). Then, the operating member 31 cooperates with the actuator to pull the spring 34. When the operating member 31 moves to a given position, the moving contact plate 33 which has been in contact with the fixed contact so far is changed over quickly by the tensile force of the spring 34 to make the fixed contact 28. Thus, the automatic stop switches 17 and 18 are changed over, and the motor 1 and driving coil 10 are deenergized, and the result is that the disc 6 is drawn back by virtue of the spring 11 concurrently with the stopping of the motor 1, the friction plates 7 and 9 separate from each other and actuator 13 stops turning. After a fixed time, the timer 24 ceases from operating and the relay 25 also becomes inactive and resets. Then, the automatic stops switches 17 and 18 change over to the side where the motor 1 is reversed. In the unlocking operation, upon pulling up the lock knob 23 at the driver's seat side after the car is stopped, the manual-operated lock switches 22 return to the unlocking side and at the same time, the timer 24 and the relay 25 begin to work. Because of the automatic stop switches 17 and 18 having changed over to the opposite side, the motor 1 is reversed and the driving coil 10 is energized, whereby magnetomotive force is generated which attracts the disc 6 to contact the friction plates 7 and 9, turning the actuator 13 in a direction opposite to the arrow A. The result is that the aforesaid linkage moves in the opposite direction, whereby the lock knobs of the respective doors are pushed up to unlock the doors.

By the operation of the actuator 13, the automatic stop switches 17 and 18 are changed over to the side where the motor 1 stops and the driving coil 10 is deenergized and as a result, the disc 6 is drawn back to the original position thereof, the friction plates 7 and 9 come off each other and the actuator 13 ceases from turning. Also, after a fixed time, the timer 24 and relay 25 stop working. In the present invention, since the friction plates 7 and 9 are separate from each other while the driving coil 10 remains deenergized, the manual operation of the lock knobs is accomplished smoothly. The car door lock driving device of the present invention has such construction and operation as described above, therefore it can offer specific advantages shown below.

(a) As described hereinbefore, the car door driving device comprises substantially a motor, reduction gearing adapted to increase the motor torque and further, an electromagnetic clutch installed at the output side of said reduction gearing and functioning to transmit and cut a torque obtained from the output side of the reduction gearing to/off a linkage which controls to lock and unlock the doors. Thus, an adequate operating stroke at a time of locking and unlocking operation and a specified driving power are easily obtainable and further the device per se can be made compact and lightweight.

(b) As it is so constructed as to increase the motor torque through the reduction gearing, the motor per se can also be built into a pocket size one with a small capacity, which helps to reduce the power consumption and enables the capacity of the switch which controls energization and de-energization of the motor to be smaller as well.

(c) Between the reduction gearing used for increasing the motor torque and the actuator which operates a linkage, an electromagnetic clutch is provided which operates only while said motor is in motion, thus providing easy operation of the lock knobs of the respective doors in the case of completion of locking and/or unlocking the doors.

(d) Since the device can easily be made compact, it is attachable on the upper portion inside each door, thus eliminating the possibility of being affected by water entering the doors.

(e) As the device comprises chiefly a motor, reduction gearing and electromagnetic clutch, the operating sound is considerably low compared with that of the conventional solenoid type one.

What is claimed is:

1. A car door lock driving device comprising:

a motor, reduction gearing having an input side and an output side, said input side connected to the motor for increasing the motor torque, and means, including an electromagnetic clutch, for transmitting the torque from said output side of said reduction gearing to a linkage to alternately lock and unlock the car door.

2. A car door lock device comprising:

a motor, reduction gearing having an input side and an output side, said input connected to the motor for increasing the motor torque, an electromagnetic clutch connected to the output side of the reduction gearing for transmitting torque from said output side, an actuator connected to said electromagnetic clutch to receive the torque from the clutch and transmit said torque to a linkage to alternately lock and unlock the car door, and automatic stop switches connected to said actuator and responsive to the transmission of said torque by said actuator to stop said motor.

3. A car door lock driving device comprising:

a switch, a lock knob connected to said switch, a timer coupled to said switch and actuated by movement of said lock knob, a relay coupled to the timer and energized by the operation of said timer, a motor and driving coil both coupled to the relay and energized by the operation of said relay, reduction gearing connected to the motor to be driven thereby, an electromagnetic clutch connected to said reduction gearing for transmitting torque in response to the energization of the driving coil, an actuator connected to said electromagnetic clutch to receive torque from the clutch and transmit said torque to a linkage to alternately lock and unlock the car door, and automatic stop switches connected to said actuator and responsive to the transmission of torque by said actuator to stop said motor.

4. The car door lock driving device according to claim 1, 2 or 3 wherein said reduction gearing comprises a sun gear, a planetary gear revolving around said sun gear while self-rotating according to the rotation of said sun gear, and an internal gear rotating at low speed according to the rotary motion of said planetary gear.

5. The car door lock driving device according to claim 1, 2 or 3 wherein said electromagnetic clutch comprises a disc, a first friction plate secured to the disc, a receiving plate, a second friction plate secured to the receiving plate, a driving coil for urging said first and second friction plates into engagement, and a spring biasing said disc away from said receiving plate.

6. The car door lock driving device according to claim 2 or 3 wherein each of said automatic stop switches comprises an operating member connected to said actuator, a housing through which said operating member extends, two fixed terminals fitted in parallel in said housing, a supporting piece secured in place in said housing, a moving contact plate fitted to said supporting piece in a freely swingable state and a spring hooked onto said moving contact plate and said operating member.

7. A car door lock driving system for a car having a plurality of doors comprising, for one of the doors:

a switch;

a lock knob connected to said switch, a timer coupled to said switch and actuated by movement of said lock knob, and a relay coupled to the timer and energized by the operation of said timer, and for each of the other doors:

a motor and driving coil both coupled to the relay and energized by the operation of said relay, reduction gearing connected to the motor to be driven thereby, an electromagnetic clutch connected to said reduction gearing for transmitting torque in response to the energization of the driving coil, an acutator connected to said electromagnetic clutch to receive torque from the clutch and transmit said torque to a linkage to alternately lock and unlock the car door, and automatic stop switches connected to said actuator and responsive to the transmission of torque by said actuator to stop said motor.

* * * * *

UNITED STATES PATENT AND TRADEMARK OFFICE

CERTIFICATE OF CORRECTION

PATENT NO. : 4,223,927

DATED : September 23, 1980

INVENTOR(S) : NOBUO KOBAYASHI ET AL

It is certified that error appears in the above—identified patent and that said Letters Patent is hereby corrected as shown below:

Column 5, line 20 -- driving -- should be inserted after "lock".

Column 5, line 22, -- side -- should be inserted after "input".

Signed and Sealed this

*Third* Day of *February 1981*

[SEAL]

*Attest:*

RENE D. TEGTMEYER

*Attesting Officer*

*Acting Commissioner of Patents and Trademarks*